United States Patent [19]

Booras

[11] 3,946,508

[45] Mar. 30, 1976

[54] SCENE-CHANGING DISPLAY CARD

[75] Inventor: Peter J. Booras, Keene, N.H.

[73] Assignee: Yankee Artists, Inc., Keene, N.H.

[22] Filed: June 5, 1975

[21] Appl. No.: 584,032

Related U.S. Application Data

[63] Continuation-in-part of Ser. No. 341,518, March 15, 1973, abandoned.

[52] U.S. Cl. ..... 40/124.1; 46/37; 229/71

[51] Int. Cl.[2] ..... G09F 1/00

[58] Field of Search ..... 46/34, 35, 36, 37; 40/124.1, 106.51, 65, 126 A; 283/1 B; 35/26; 229/71, 74, 75, 76

[56] References Cited

UNITED STATES PATENTS

| | | | |
|---|---|---|---|
| 667,426 | 2/1901 | De Long et al. | 283/1 B |
| 850,150 | 4/1907 | Glazier | 46/36 |
| 944,385 | 12/1909 | Spiegel | 46/36 UX |
| 1,211,497 | 1/1917 | Spiegel | 40/106.51 |
| 1,259,297 | 3/1918 | Russell | 40/106.51 |
| 1,709,831 | 4/1929 | Baker | 40/65 |
| 2,145,794 | 1/1939 | Huber | 46/34 |
| 2,367,967 | 1/1945 | Schwartz | 40/106.51 |
| 2,984,920 | 5/1961 | Acosta et al. | 40/124.1 |
| 3,225,474 | 12/1965 | Dusseau | 46/34 X |

FOREIGN PATENTS OR APPLICATIONS

| | | | |
|---|---|---|---|
| 350,507 | 6/1931 | United Kingdom | 46/34 |

*Primary Examiner*—Richard C. Pinkham
*Assistant Examiner*—Arnold W. Kramer
*Attorney, Agent, or Firm*—Morgan, Finnegan, Pine, Foley & Lee

[57] ABSTRACT

A display card of the pull card type having a swinging operating tab for sliding an intermediate display leaf between a back leaf and the display aperture of a front display leaf to shift the intermediate display leaf and change the scene or message visible through the display aperture. The front and back leaves are joined at their sides by folds which provide an envelope for the sliding intermediate leaf and which also serve as relatively long guides for the sliding intermediate leaf; and the tab has two spaced hinge-like folds, one connecting one of the two layers of the tab to the intermediate leaf and the other fold connecting its other layer to a flexible projecting section of the back leaf. The two ends of the envelope are open and the intermediate leaf may be elongated to extend beyond the end of the envelope when the tab is in the folded position.

13 Claims, 11 Drawing Figures

SCENE-CHANGING DISPLAY CARD

CROSS-REFERENCE TO RELATED APPLICATION

This application is a continuation-in-part of my copending application, Ser. No. 341,518 which was filed Mar. 15, 1973 and now abandoned.

BACKGROUND AND OBJECTS OF THE INVENTION

The present invention is concerned with display cards of the types employed as greeting cards and also those used for advertising and similar purposes. More particularly, it is directed at display-changing or scene-changing cards, and especially the kind usually described as pull cards.

A great variety of pull cards have been devised and marketed in various forms, and their greatest popularity has probably been in the field of humorous greeting cards. In many embodiments of such cards, either a message or an illustration or both are visible on an interior leaf through an opening in the front page or cover of the card in its closed position; then upon opening the card, the scene or message inside is shifted by some means operated by the opening of the card to provide a humorous finale in the form of a punch line or startlingly different scene from the original message or scene.

Huber U.S. Pat. No. 2,145,794 describes an embodiment of a greeting card wherein unfolding the folded end of the picture card serves "to present a relatively long and different picture" thereon by turning one panel to the rear where it is no longer visible, uncovering a folded panel, pulling a narrow extension or tongue through a vertical slit from concealment under the front leaf of the card and retaining one of the original front panels in view. Since the tongue is completely covered and thus not visible when the card is folded, it plays no greater part in providing a different picture than the panel that is also covered in the folded position.

Although this interesting pull card has a number of good features, the tongue appears to create some obvious problems and limitations without providing any significant advantages. Difficulties are likely to be encountered in assembling the card, for a narrow tongue or extension is weak and prone to binding, jamming, bunching or tearing in inserting the tongue through the slit in the front leaf thereby creating some production problems. Also there are limits on the length of that slit, and consequently the width of the tongue, if one is to avoid weakening the front leaf to the extent where the slit would tear through to the edge of the leaf. Of course, thicker sheet material can be used to increase the tear strength, but it can also substantially increase the resistance of the material to folding and/or to the sliding motion of the tongue as well as increase the weight and mailing costs. The ends of a slit leave much to be desired as guide means since each end exerts its guiding influence at one point only along the length of the sliding tongue; thus the ends of the slit may tend to display more binding action than guiding action. In addition, the folded end of the card is likely to be rather bulky with its six layers and four fold lines and thus subject to disarrangement, particularly if handled roughly by children.

The present invention is directed at an improved pull card which may be constructed in an extremely simple manner of flexible sheet material which may have a rather wide range of flexural properties; and this card provides extremely smooth and well guided motion in providing movable scenes or messages under one or more display openings in the front leaf or the rear leaf or in both leaves of the card. Moreover, the invention provides for an elongated intermediate leaf to extend beyond the front leaf, allowing several scene display areas to provide a multifaceted scene-changing effect in a simple structure.

SUMMARY OF THE INVENTION

The present invention relates to a display-changing, multilayer display card which comprises a front leaf and a back leaf joined together along two spaced and substantially opposite junctions of substantial length to form a flat envelope having at least one open edge, at least one display aperture in at least one of said front and back leaves, an intermediate leaf slidably positioned between said front and back leaves and between said junctions for sliding movement beneath and relative to said display aperture, said intermediate leaf extending out of a first open edge for hinged connection with a foldable tab, said tab being affixed to a flexible section of one of said front and back leaves at an operating fold line substantially perpendicular to the direction of said sliding movement, the pivot of said hinged connection being spaced away from said fold line and toward said open edge when said tab is in the folded position, and said pivot being located farther than said fold line from said open edge when said tab is in the open position, whereby said intermediate leaf is shifted by the opening of said tab to present a different display area of said intermediate leaf than the display area initially visible through said display aperture.

Advantageously, the flat envelope is formed with two open edges at opposite ends thereof and the intermediate leaf is elongated such that its free end extends beyond the second open edge when the tab is in the closed position.

Other aspects of the invention relate to one or more of such features as the disposition and character of the aforesaid junctions as well as the shape of the leaves which are preferably rectangular; the preferred structure of the tab, or the arrangement of the fold lines in one preferred embodiment wherein the entire card is integrally constructed from a single blank or cutout from sheet material without any further cutting of the blank being necessary.

DESCRIPTION OF THE PREFERRED EMBODIMENTS

The features of the present invention as well as its objects and advantages can be illustrated by describing the fabrication and structural features of its preferred embodiments shown in the attached drawings.

Figure 1:
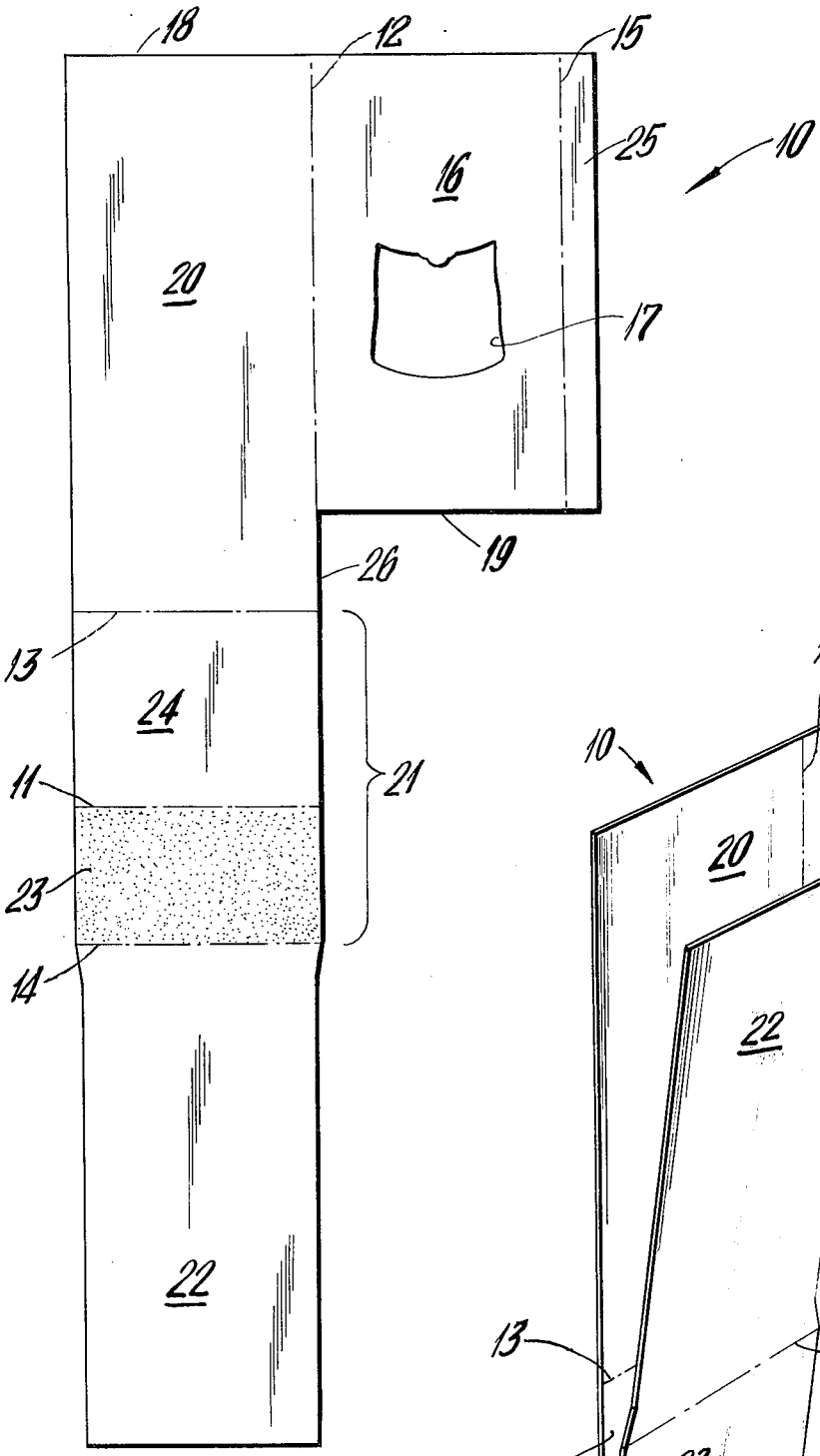
FIG. 1 is a plan view of the unprinted side of a blank or cutout from which one embodiment of the cards of the present invention is constructed.

Referring now more particularly to the embodiment of the invention shown in FIG. 1, an L-shaped blank 10 of a suitable type of flexible sheet material (e.g., papers and paperboards of varying weights, foils, polyethylene and other flexible resins in sheet form) is subjected to a series of folding steps along the five fold lines 11, 12, 13, 14 and 15 as well as cementing or bonding operations. These fold lines are important structural features of the novel display cards and the manner and purpose of each of the various folds are described hereinafter. The blank is prepared in a preliminary stamping or cutting operation of a conventional type on the sheet material; and it is often desirable to score or indent the fold lines in the material at the same time. The unprinted face or side of the blank is shown in FIG. 1, and the other side bears the selected pictures, messages, etc., inscribed in any desired colors. Preferably, such printing of one side of the card is accomplished before any die cutting operations.

The blank 10 is composed of several sections including front display leaf 16 located in one branch of the L and having a display opening or aperture 17; and this leaf extends from the edge 18 to the edge 19. The other, and usually longer, branch of the L provides a back leaf 20, a tab section 21 and an intermediate leaf 22 located adjacent to the far end of that branch. A pressure sensitive adhesive coating may be provided for the entire area 23 between the fold lines 11 and 14 in order to improve operation of the device and also strengthen the tab after it has been folded; alternatively, the adhesive may be coated on the corresponding area of section 24 or both areas may be coated. It will be noted that the intermediate leaf 22 is tapered in the general location of the fold line 14 thereby reducing its width to a small extent so that leaf 22 will slide freely back and forth between the front and back leaves 16 and 20 after assembly of the card is completed.

Figure 2:
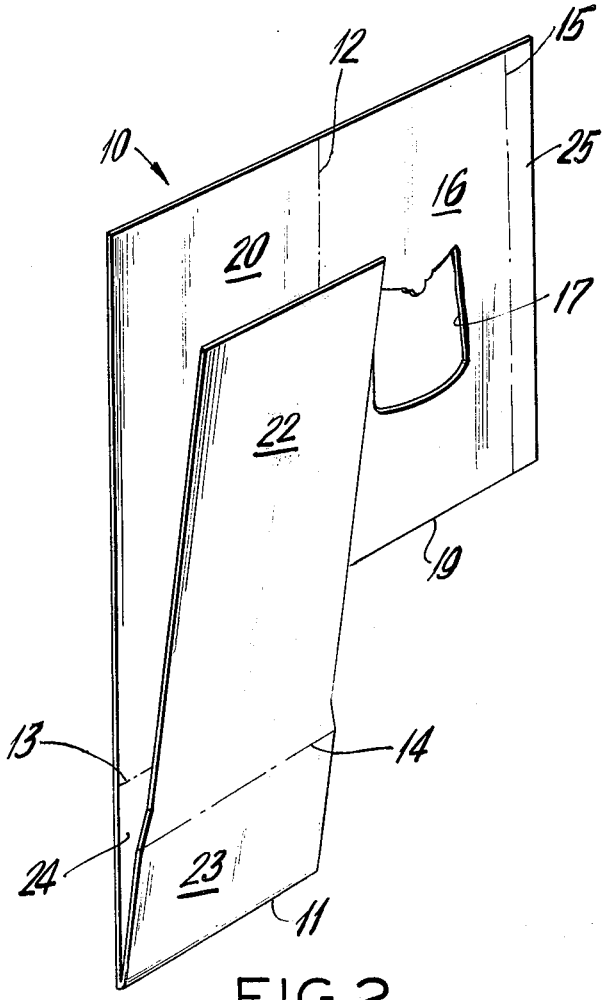
FIG. 2 is a perspective view in which the blank is partially folded to provide the movable intermediate leaf.

FIG. 2 shows the first folding operation for fabricating the card by folding the sheet material along the line 11 so that the intermediate leaf 22 is directly on top of the back leaf 20. Also, the section 23 of the tab is cemented to that part of the area of section 24 which is contacted by section 23 in folding.

Figure 3:
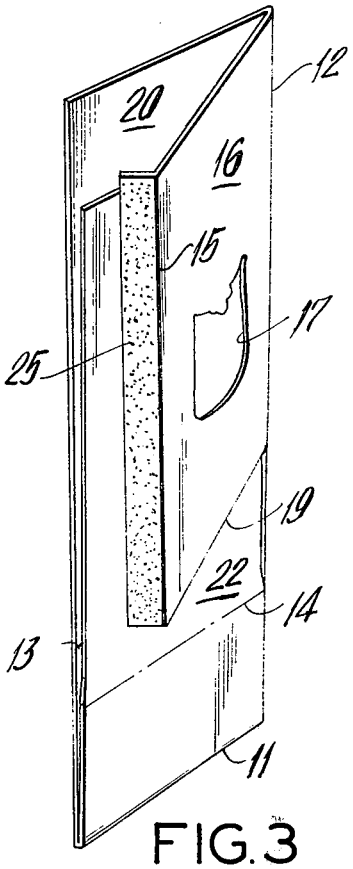
FIG. 3 is another perspective view at a further stage in making the card, and it depicts the partial folding over of the front leaf in preparation for joining its edge to the back leaf.
Figure 4:
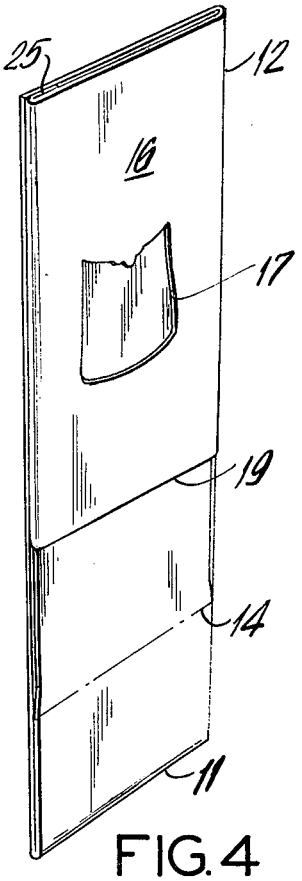
FIG. 4 is a perspective view of a completed card in the open position.
Figure 5:
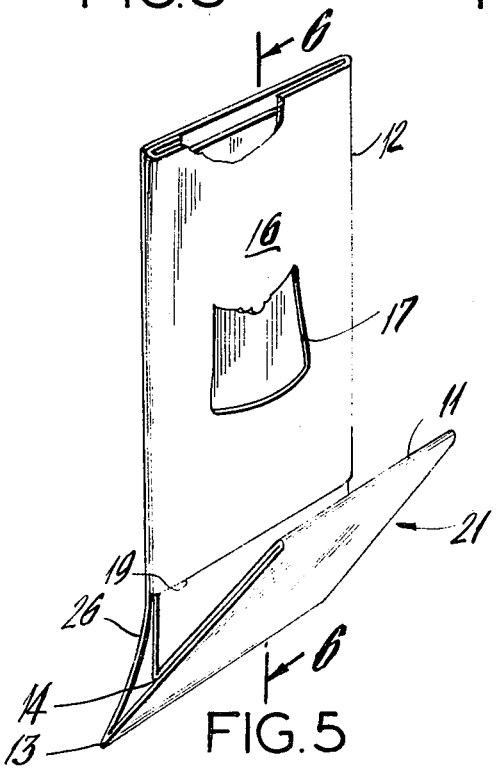
FIG. 5 is a perspective view showing the completed card in a partially folded position.

Next, the front leaf 16 is folded along fold line 12 over the intermediate leaf 22 as in FIG. 3, preferably after there has been a preliminary creasing flexing or partial folding along the fold line 15 of a marginal section 25 which is coated with a pressure sensitive or other suitable adhesive for adhering the front leaf 16 to the back leaf 20. With due attention to the placement of the adhesive, the marginal section 25 can be adhered to either face of the back leaf 20, but it is preferred to fold section 25 in between the front and back leaves and bond it to the inner face of the back leaf 20 as shown in FIGS. 4 and 5, inasmuch as this provides more space beween the inner surfaces of leaves 16 and 20 for easy operation of the movable intermediate layer 22. The card is now complete except for folding the tab along the two fold lines 13 and 14 which are the pivots of hinged connections.

The construction of this embodiment of the invention is extremely simple as it involves only five folds and the use of an adhesive in forming a flat envelope provided with a reciprocating inner display leaf 22 which is operated through the open edge 19 by the tab section 21. Advantageously, the opposite edge 18 of the envelope is opened to allow substantially unobstructed sliding of intermediate leaf 22 by avoiding the pinching effect on its free end caused by a closed edge and to accommodate, as hereinafter explained, extension of leaf 22. Of the fold lines, lines 11, 13 and 14 are disposed in a direction that is substantially perpendicular to the direction of motion of the inner leaf while fold lines 12 and 15 are parallel to the direction of motion and the latter two folds function as guides for the smooth operation of movable leaf 22 in addition to serving as junctions between the front and back leaves 16 and 20.

Figure 6:
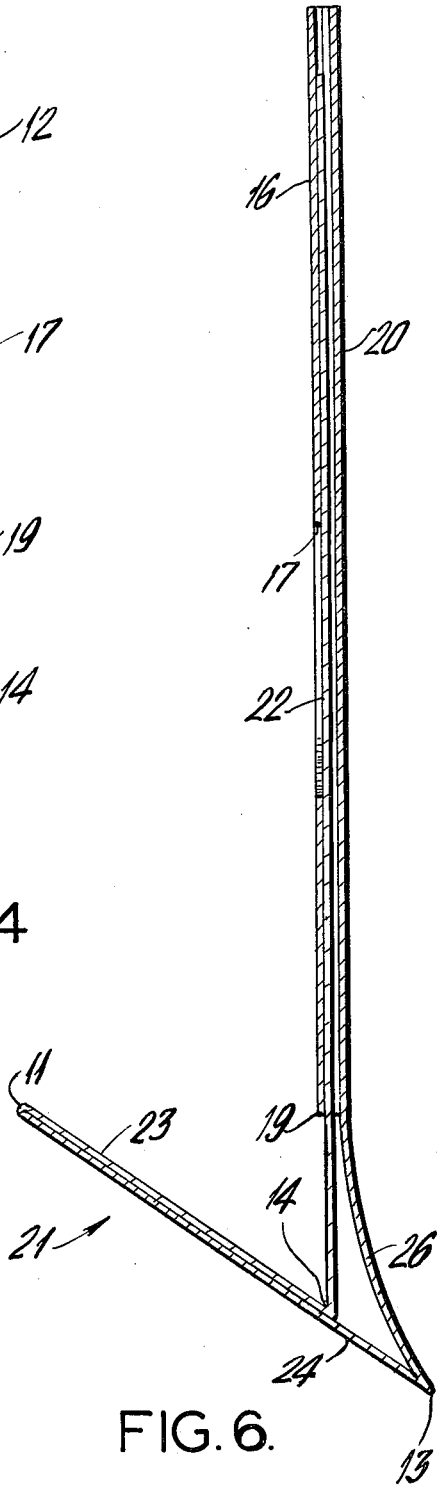
FIG. 6 is an enlarged sectional view taken on the plane of the line 6—6 of FIG. 5.

By reference to FIG. 6, it will be apparent that in operating the device, swinging the tab 21 counterclockwise from the fully closed to the fully opened position about the pivot or hinge 13 will move the intermediate leaf 22 a distance or "throw" equal to twice the distance between the hinge connections or pivots 13 and 14. This is significant in respect to the length of the aperture or display window 17 in the direction of motion, as the length of that window may be less or it may be equal to that throw, but it should not exceed the throw if there is to be a complete change of the scene or message visible through the display aperture 17. However, a window of greater length in the direction of motion is suitable in instances where only a partial change of scene is desired.

In pulling open the tab 21, the hinge line 13 is displaced backwards, that is to the rear of the normal plane of the back leaf 20. In other words, one end of the back leaf is bent backwards as may be seen in FIG. 6; therefore the extended panel 26 of leaf 20 between the open edge 19 of the envelope and fold line 13 must be sufficiently flexible to permit such displacement of the pivot line 13. Provision for such flexibility can be readily made by balancing material and design factors. For example, by selecting a sheet material of suitable flexibility for making the display card, leaf 20 or at least panel section 26 thereof and/or by adjusting the distance or length of that panel between edge 19 and hinge 13. Such matters are best determined by simple experimentation on the basis that an increase in the length of panel 26 allows a greater degree of flexing with any flexible sheet material and consequently of displacement of hinge 13.

On the other hand, lengthening the motion or throw of the intermediate layer 22 by increasing the distance between the two pivot lines 13 and 14 will involve a greater backward displacement of the pivot 13. Swinging the tab 21 open or closed involves only a minor and insignificant deflection of inner leaf 22 from its flat plane, for essentially all of the flexure occurs in the panel 26.

The length of the tab between fold lines 11 and 14 is often a matter of choice as it is only necessary that this section be long enough to provide a tab having sufficient leverage for operation of the card by persons, including children and others who may not be adept in the use of their hands. Thus, in many instances, the distance between 11 and 14 may be relatively short. However, it may be desirable to provide a relatively long tab in order to have a message or picture of substantial area hidden on the folded panel 23 and the underlying section of the card, and even extending up to the edge of the aperture 17 because that scene also will be changed relative to whatever picture may be on the exposed panel 24.

Panel 22 may be made of either flexible or relatively stiff material, but typically the entire article is made of a single sheet of material; therefore panel 22 is customarily made of the same flexible material as panel 26.

Although the embodiment of the display card described hereinbefore is one wherein the operating tab 21 is attached to the back leaf 20 rather than the front leaf 16, it will be apparent to those skilled in the art that the arrangement of sheets could be reversed by simply providing the display aperture in leaf 20 and having the changing scene printed on the face of intermediate layer 22 which is adjacent to leaf 20; then leaf 20 becomes the front leaf and the pull tab is now affixed to the front leaf. In general, this arrangement is somewhat less desirable as its operation may not be as readily apparent to the user, and one could not employ the hidden tab panel 23 as additional scene-changing space. Another alternative is providing display apertures 17 in both front leaf 16 and back leaf 20 with changing scenes imprinted on both faces of the intermediate layer 22. This would of course involve printing both sides of the blank 10 in FIG. 1.

The cards of the present invention have been described as articles of integral construction which are fabricated from unitary blanks solely by folding and cementing operations inasmuch as such construction is generally preferred for simplicity, minimum cost and also usually greater strength; nevertheless the present cards could be assembled from a number of smaller blanks by fastening them together with adhesives, staples or binding the edges with adhesive tapes. Such tapes may be employed to form the hinge lines 13 and 14 or to reinforce ordinary folds with a layer of strong adhesive tape.

In the embodiment of the invention shown in FIGS. 1–6, the tab sheet 21 is composed of panels 23 and 24 which may be cemented together from the first fold line 11 to the fourth fold line 14. Such structure is often preferred for providing an operating tab of high strength and durability as is particularly desirable for cards intended for children or those constructed of a relatively heavy sheet material. However, other tab constructions may be employed as exemplified by using a narrow band of adhesive between the two panels 23 and 24 at a location close to the pivot 14 to join the panels there as well as at the fold at 11; or one could use a row of staples instead of the adhesive. Moreover, the pivot 14 need not be attached to the panel 24 in embodiments where durability is not important, for the operator's thumb will tend to place the fold line 14 into essentially the correct operating position so long as the two panels 23 and 24 are joined at the fold 11. However, from a practical standpoint, it is essential that panels 23 and 24 be jointed at either the fold line 11 or the hinge line 14 in order to obtain the necessary registery of the scenes or messages on the inner layer 22.

Referring generally to FIGS. 7 and 8, there are shown alternate embodiments of a particularly useful aspect of the present invention wherein the intermediate leaf 22 is lengthened. It should be understood that the above description of the embodiments shown in FIGS. 1–6 is equally pertinent to the embodiments described with reference to FIGS. 7 and 8. Thus, except as hereinafter described, the structures, fabrication, mode of operation and advantages of the embodiments shown in FIGS. 1–6 are identical to those of the embodiments shown in FIGS. 7 and 8.

Figures 7A, 7B, 8A, 8B, 8C:
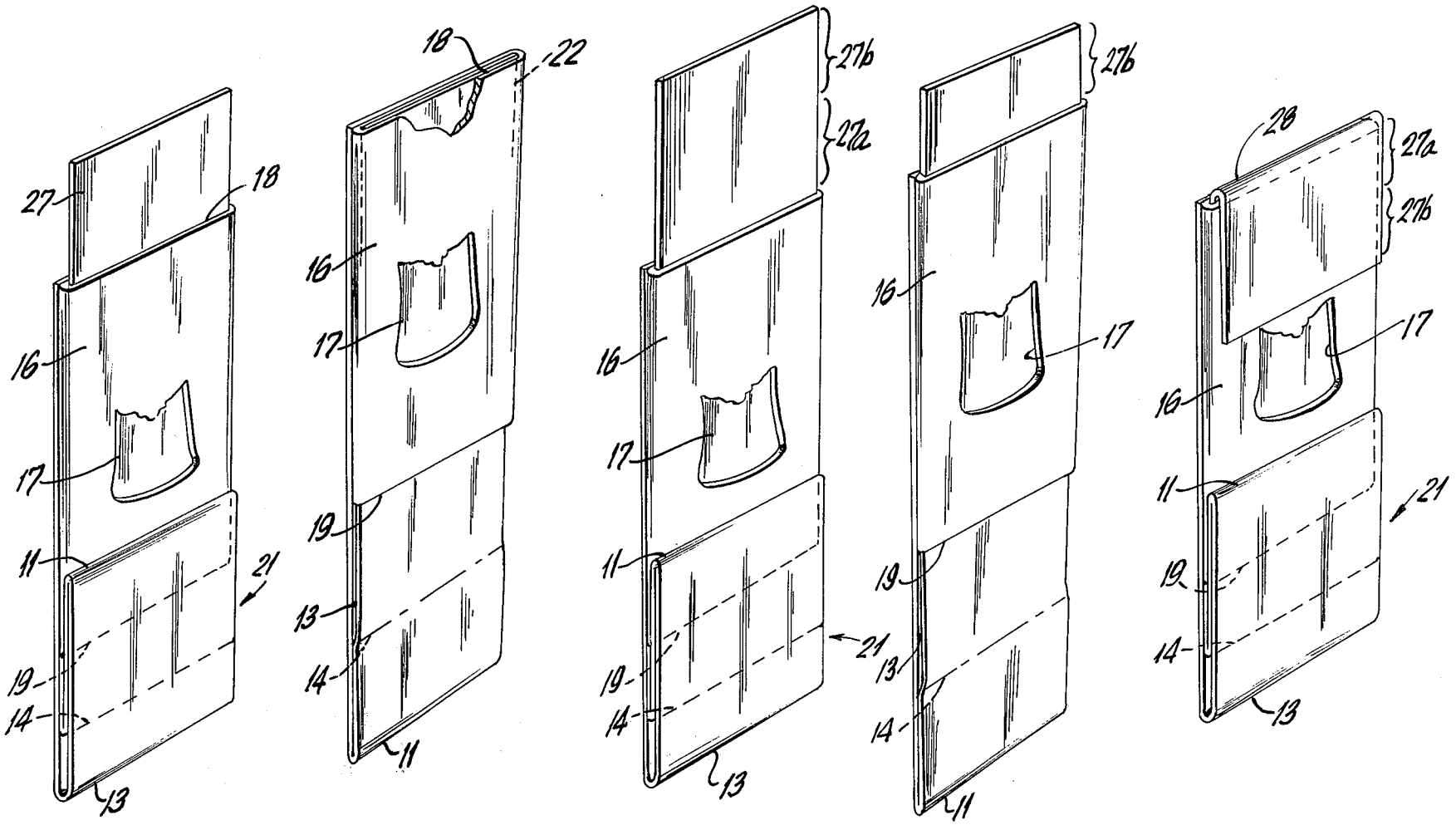
FIGS. 7*a–b* are perspective views of a completed card having an extended intermediate leaf according to another embodiment of the present invention.
FIGS. 8*a–c* are perspective views illustrating alternate embodiments of the scene-changing display device shown in FIGS. 7*a–b*.

Referring now more particularly to FIGS. 7*a–b*, there is shown one embodiment of the present invention wherein intermediate leaf 22 is provided with extended member 27 which elongates leaf 22 to extend beyond open edge 18 of the envelope formed by front leaf 16 and back leaf 20 when the foldable tab 21 is in the closed position. Advantageously, and as here preferably embodied, the length of extended member 27 is no longer than the "throw" distance intermediate leaf 22 travels when tab 21 has been shifted to its fully opened position, as discussed with reference to FIG. 6. Thus, according to this embodiment, the length of extended member 27 is no more than twice the distance between the hinge pivots 13 and 14 of the assembled card.

Accordingly, when tab 21 is in the closed position as shown in FIG. 7*a*, extended member 27 provides an additional display surface for use in conjunction with the scenes on front leaf 16, on the portions of the intermediate leaf 22 exposed by the display apertures formed in front leaf 16, and, if used, on back leaf 20. However, when tab 21 is in the fully open position as shown in FIG. 7*b*, extended member 27 is completely withdrawn into the envelope formed between the front and back leaves, to remove from view the scenes and/or messages printed on member 27 as part of the change of scene effect. Advantageously, extended member 27 may be provided with a scene and/or message only on its front surface which slides directly adjacent front leaf 16 in order that the device may be completely printed on one side of the unassembled blank.

Referring now to FIGS. 8*a–b*, there is shown an alternate embodiment to that shown in FIG. 7*a*. Advantageously, and as here preferably embodied, intermediate leaf 22 is provided with extended member 27, comprising portions 27*a* and 27*b*, having a length greater than the "throw" distance of intermediate leaf 22. Thus, according to this embodiment, portion of 27*a* of extended member 27 is equal to twice the distance between hinge pivots 13 and 14 of the assembled card while portion 27*b* may be any desired length for creating the intended effect during operation as explained below.

Accordingly, when tab 21 is in the folded position as shown in FIG. 8a, extended member 27 provides an additional display surface, on both portions 27*a* and 27*b*, for use in conjunction with other printing on the device. However, when tab 21 is in the fully open position as shown in FIG. 8*b*, portion 27*a*, originally visible, is encased by the envelope formed between the front and back leaves, leaving only portion 27*b* exposed to view. Thus, the structure according to this aspect of the invention is particularly useful for creating only a partial change of scene and/or message printed on member 27 in conjunction with the change of scene provided by display aperture 17 and tab 21. Advantageously, the scene and/or message on member 27 is printed only on its front face, which is immediately adjacent front leaf 16, in order that complete printing may be accomplished on one side of the unassembled blank.

FIG. 8*c* illustrates a modified version of the alternate embodiment shown in FIGS. 8*a–b*. According to this embodiment, the extended member 27, comprising portions 27*a* and 27*b*, may be folded over front leaf 16 along a sixth fold line 28, such as one generally coincident with open edge 18 of the envelope, when tab 21 is in the folded position as shown in FIG. 8*c*. Advantageously, the rear surface of extended member 27, which faces forward when folded as shown in FIG. 8*c*, may be unprinted to function simply as a cover for a scene and/or message printed on front leaf 16 near edge 18, and, the front surface of portion 27*b*, which faces in towards the display surface of front leaf 16 when folded as shown in FIG. 8*c*, may be provided with a message and/or scene to appear when tab 21 is shifted to its open position.

In the operation of this embodiment, when tab 21 is shifted to its fully open position, which is illustrated in FIG. 8*b*, member 27 is flipped open as intermediate leaf 22 slides within the envelope, to reveal both the previously hidden display on front leaf 16 near the edge 18 and the printing on the front face of portion 27*b*. Thus, two additional display surfaces are provided for facilitating a greater change of scene effect in a substantially simple structure which still may be completely printed on one side of the unassembled blank.

Alternatively, extended member 27 may be provided with printing on its rear surface, as well as on the front surface of portion 27*b*. Thus, when tab 21 is in the folded position, the entire back face of member 27 may be printed with a scene and/or message in conjunction with a display on the front leaf 16, and, when tab 21 is shifted to the open position, the front face of portion 27*b* and the previously covered portion of front leaf 16 near edge 18 are revealed to generate the desired change of scene. Although this embodiment entails an additional printing operation, a scene-changing display device is provided which generates a multi-faceted change of scene effect in a substantially simple structure.

While the present invention has been described in connection with display cards in the form of a movable rectangular intermediate display leaf 22 sliding back and forth between the parallel folded edges or junctions of leaf 16 and 20 which are also rectangular, it will be apparent to those skilled in the art that other shapes or configurations of the three leaves may also be employed with the multilayered cards described herein. For example, the intermediate layer might have one straight edge that is guided by one of the aforesaid junctions while the other edge might be of irregular outline and have only one point subject to guidance by the other junction.

From the foregoing description, it is apparent that the novel pull cards are not only simple, rugged and very versatile as to arrangement of scenes but also extremely smooth in operation. They are very easy to fabricate in an economical manner from a large variety of sheet materials of a wide range of flexural characteristics. In addition, their construction has the desirable of requiring printing on one side only in making the usual style of scene-changing card.

While the present invention has been set forth in detail in respect to only a few embodiments in the foregoing description it will be readily apparent to those skilled in the art that the articles of this invention may be modified in many ways relative to their configuration, structure or materials of construction. Accordingly, this invention should not be construed as limited in any particulars except as may be recited in the appended claims or required by the prior art.

What is claimed is:

1. A display-changing multilayer display device which comprises a front leaf and a back leaf joined together along two spaced and substantially opposite junctions of substantial length to form a flat envelope having two open edges on opposite ends thereof, at least one display aperture in at least one of said front and back leaves, an intermediate leaf slidably positioned between said front and back leaves and between said junctions for sliding movement beneath and relative to said display aperture, said intermediate leaf extending out of a first edge of said open edges for hinged connection with a foldable tab, said tab being affixed to a flexible section of one of said front and back leaves at an operating fold line substantially perpendicular to the direction of said sliding movement, the pivot of said hinged connection being spaced away from said fold line and toward said first open edge when said tab is in the folded position, and said pivot being located farther than said fold line from said first open edge when said tab is in the open position, and said envelope being open at a second edge of said open edges to accommodate extension of said intermediate leaf at its free end when said tab is in the folded position, whereby said intermediate leaf is shifted by the opening of said tab to present a different display area of said intermediate leaf than the display area initially visible through said display aperture.

2. A display device according to claim 1 wherein said intermediate leaf is provided with an extended member which extends beyond said second edge when said tab is in the folded position to present an additional display area of said intermediate leaf when said tab is in the folded position whereby when said intermediate leaf is shifted, to present a different area of said intermediate leaf than the display area initially visible through said display aperture and on said extended member.

3. A display device according to claim 2 wherein said extended member also extends beyond said second edge when said tab is in the open position.

4. A display device according to claim 3 wherein at least one of said junctions is disposed along a straight line and serves as a guide means for rectilinear motion of an adjacent and substantially parallel straight edge of said intermediate leaf.

5. A display device according to claim 4 wherein said junctions are substantially parallel.

6. A display device according to claim 5 wherein said front, back and intermediate leaves are of a substantially rectangular shape.

7. A display device according to claim 6 which comprises a single sheet of flexible material folded along a first fold line substantially perpendicular to the direction of said rectilinear sliding motion to provide said intermediate leaf overlying said back leaf, said sheet being folded along a second fold line substantially parallel to the direction of said motion to superimpose said front leaf over said intermediate leaf and to form one of said junctions, said back leaf having a third fold line substantially perpendicular to the direction of said motion and at a substantial distance from said first open edge of said envelope to provide said operating fold line of said tab, and said intermediate leaf having a fourth fold line substantially perpendicular to the direction of said motion to form said hinged connection to said tab at a location between said third fold line and said first open edge when said tab is in the folded position.

8. A display device according to claim 7 wherein said tab comprises two layers of said flexible material joined at said first fold line and at said fourth fold line.

9. A display device according to claim 7 wherein said tab comprises two layers of said flexible material united over substantially the entire area extending from said first fold line to said fourth fold line.

10. A display device according to claim 7 wherein one of said front and back leaves is folded along a fifth fold line substantially parallel to and spaced from said second fold line to provide the second of said junctions.

11. A display device according to claim 10 wherein said single sheet is substantially L-shaped, having a generally short leg member orthogonally intersecting a generally long leg member, said front leaf being formed by folding said short leg member along said second fold line substantially coincident with the intersection of said short and long leg members, and said fifth fold line being formed on said short leg member substantially near its free end and spaced from said second fold line a distance equal to about the width of said back leaf.

12. A display device according to claim 11 wherein the width of said intermediate leaf is slightly less than the widths of said front and back leaves.

13. A display device according to claim 11 wherein said extended member of said intermediate leaf is folded over said front leaf along a sixth fold line, substantially parallel to said first fold line, to cover a portion of said front leaf near said second edge when said tab is in the folded position such that when said tab is shifted to its open position, said extended member flips over as said intermediate leaf slides within said envelope to expose the entire surface of said front leaf.

* * * * *